US012460428B2

(12) United States Patent
Neuhofer

(10) Patent No.: US 12,460,428 B2
(45) Date of Patent: Nov. 4, 2025

(54) DEVICE FOR FASTENING A FINISHING STRIP

(71) Applicant: Franz Neuhofer, Zell am Moos (AT)

(72) Inventor: Franz Neuhofer, Zell am Moos (AT)

( * ) Notice: Subject to any disclaimer, the term of this patent is extended or adjusted under 35 U.S.C. 154(b) by 212 days.

(21) Appl. No.: 18/274,857

(22) PCT Filed: Dec. 28, 2021

(86) PCT No.: PCT/AT2021/060488

§ 371 (c)(1),
(2) Date: Jul. 28, 2023

(87) PCT Pub. No.: WO2022/159994

PCT Pub. Date: Aug. 4, 2022

(65) Prior Publication Data

US 2024/0026689 A1 Jan. 25, 2024

(30) Foreign Application Priority Data

Feb. 1, 2021 (AT) ..... A 50058/2021

(51) Int. Cl.
*E04F 19/04* (2006.01)

(52) U.S. Cl.
CPC ..... *E04F 19/0459* (2013.01)

(58) Field of Classification Search
CPC . E04F 19/045; E04F 19/0459; E04F 19/0468; E04F 15/02027; E04F 15/02025; E04F 19/0463; E04F 13/0801; E04F 11/166; E04F 19/04; E04F 2013/063; E04F 19/061

(Continued)

(56) References Cited

U.S. PATENT DOCUMENTS 3,181,662 A * 5/1965 Maertzig, Jr. ..... A47G 1/215 52/509
3,228,160 A * 1/1966 O'Brien ..... E04B 2/825 52/287.1

(Continued)

FOREIGN PATENT DOCUMENTS

DE 10107864 A1 8/2001
DE 202017102750 U1 6/2017

(Continued)

*Primary Examiner* — Brian E Glessner
*Assistant Examiner* — Adam G Barlow
(74) *Attorney, Agent, or Firm* — Tiajoloff & Kelly LLP

(57) ABSTRACT

A device for fastening an end strip (1) covering a connection joint (4) between a wall (5) and a flooring (6) has a holder that forms a wall limb (2) The holder has at least one upwardly projecting holding web (9) engaging in a downwardly open groove (10) of the end strip (1) for clampingly receiving the end strip (1), and having two leaf-spring-like spreading arms (3) attached laterally to the wall limb (2) and projecting towards the end face (7) of the flooring (6). The holder comprises a wall web (12) punched out of the wall limb (2) and delimited by a bottom edge (13) on the floor side and two side edges (14) extending from this bottom edge, the bottom edge (13) of which wall web (12) is provided with claws (17) projecting towards the wall (5), and the wall web (12) has, at a distance in height from the bottom edge (13), a slope lug (15) for the end strip (1) projecting from the wall limb (2).

17 Claims, 9 Drawing Sheets

Figure 1:
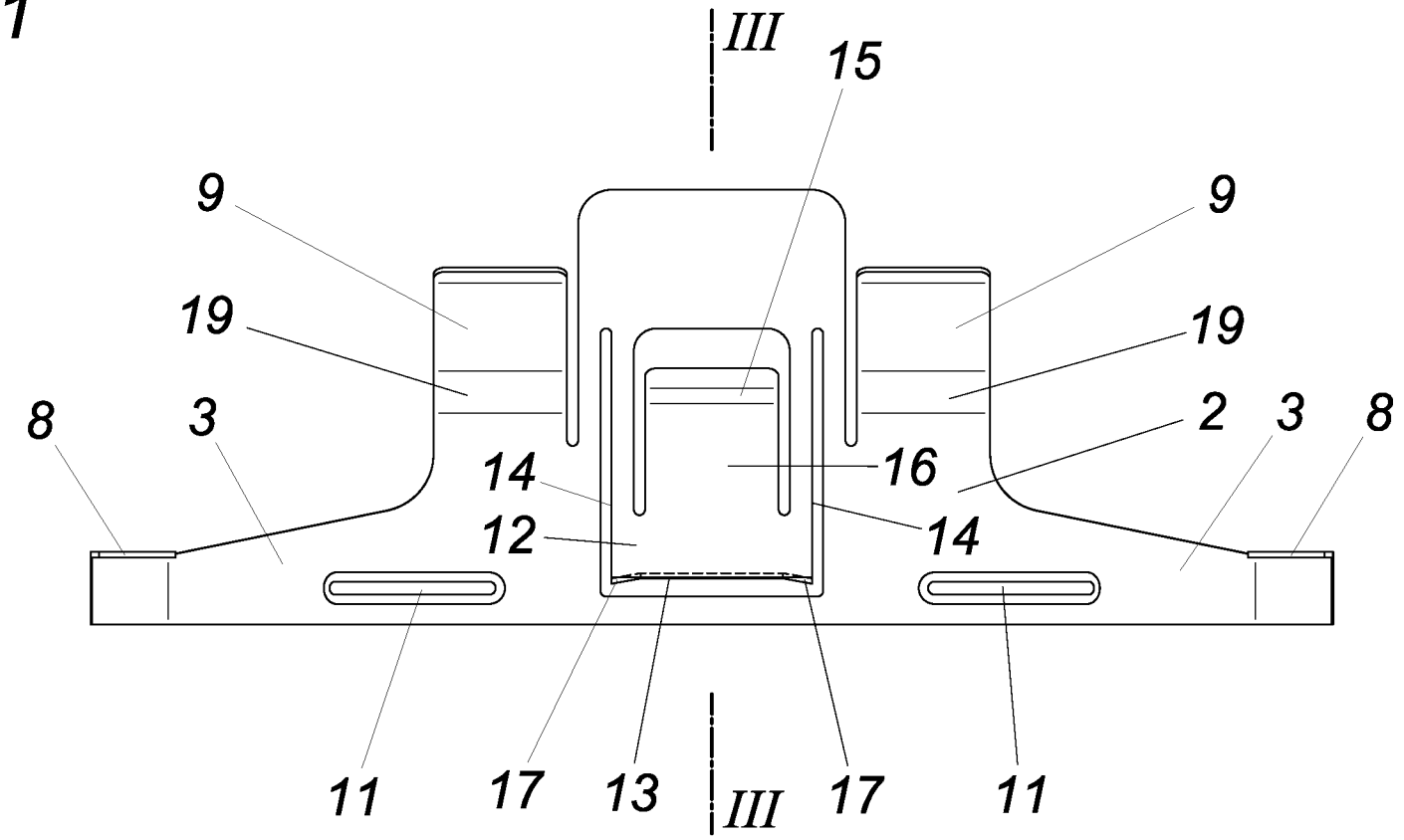

(58) Field of Classification Search
USPC .... 52/290, 483.1, 489.1, 489.2; 24/295, 329
See application file for complete search history.

(56) References Cited

U.S. PATENT DOCUMENTS 5,289,663 A * 3/1994 Schluter ..... E04F 15/02027 52/287.1
6,279,286 B1 * 8/2001 Ichihashi ..... E04F 13/0826 52/489.1
6,497,395 B1 * 12/2002 Croker ..... H02G 3/30 248/220.21
6,643,987 B2 * 11/2003 Rusch ..... E04F 19/04 52/287.1
6,766,992 B1 * 7/2004 Parker ..... F16M 13/022 248/219.3
6,830,405 B2 * 12/2004 Watanabe ..... E04F 13/0846 403/14
7,594,368 B2 * 9/2009 Kurz ..... E04F 19/0468 24/297
8,011,153 B2 * 9/2011 Orchard ..... E04F 15/02 52/489.1
8,171,698 B2 * 5/2012 Neuhofer jun. .... E04F 19/0468 52/287.1
8,341,904 B2 * 1/2013 Galas ..... E04F 19/0463 52/287.1
8,393,125 B2 * 3/2013 Martel ..... E04F 15/04 52/489.1
9,546,487 B2 * 1/2017 Neuhofer ..... E04F 19/0463
10,774,546 B2 * 9/2020 Galas ..... E04F 15/02027
2002/0112431 A1 8/2002 Rusch et al.
2004/0168384 A1 * 9/2004 Wesolowska ..... E04F 19/04 52/287.1
2009/0044469 A1 * 2/2009 Kurz ..... E04F 19/0468 52/290

FOREIGN PATENT DOCUMENTS

DE 202020101320 U1 6/2021
EP 3828362 A1 6/2021
WO 2005/116364 A1 12/2005

* cited by examiner

DEVICE FOR FASTENING A FINISHING STRIP

TECHNICAL AREA

The invention relates to a device for fastening an end strip covering a connection joint between a wall and a flooring, having a holder which forms a wall limb and which holder has at least one upwardly projecting holding web engaging in a downwardly open groove of the end strip for clampingly receiving the end strip, and having two leaf spring-like spreading arms which are attached laterally to the wall limb and project towards the end face of the flooring.

STATE OF THE ART

For fastening end strips between a wall and an adjacent flooring, it is common to provide holders on the wall that have holding webs engaging in grooves of the end strip so that the end strip only has to be pushed onto these holding webs. In order not to have to screw these holders to the wall and to be able to move them without tools, it is known (DE 20 2017 102 750 U1) to attach leaf spring-like spreading arms to the side of the wall limb of the holders, which spreading arms are supported under pretension on the end face of the flooring within the connection joint between the wall and the flooring and press the wall limb against the wall. Although the spreading arms are provided with contact teeth at their ends that interact with the end face of the flooring, it has been shown that these contact teeth, which make it difficult to insert the spreading arms into the connection joint, cannot prevent the holders from being levered out of a connection joint.

PRESENTATION OF THE INVENTION

The invention is thus based on the task of designing a device for fastening an end strip covering a connection joint between the wall and the flooring by simple structural means in such a way that, despite installation without tools, it is possible to prevent the holder from being levered out of the connection joint when the end strip is mounted.

Starting from a device of the type described at the beginning, the invention solves the problem in that the holder comprises a wall web punched out of the wall limb and delimited by a bottom edge on the floor side and two side edges extending from this bottom edge, the bottom edge of which wall web is provided with claws projecting towards the wall, and in that the wall web has, at a distance in height from the bottom edge, a slope lug for the end strip projecting from the wall limb.

If on the holder after it has been installed, i.e. in the working position where the holder is clamped in the connection joint between the wall and the flooring with the aid of the resilient spreading arms, an end strip is placed on the holding web, the end strip runs onto the projecting slope lug of the wall web punched out of the wall limb of the holder with the effect that that the wall web is pressed separately from the wall limb against the wall, whereby the associated displacement of the bottom edge of the wall web causes the claws of the wall web provided on this bottom edge to penetrate into the wall and thereby prevent the wall limb from sliding upwards along the wall, so that the holder can no longer be levered out of the connection joint when the end strip is mounted.

The wall web can be punched out of the wall limb of the holder in different ways. For example, it is possible to punch the wall web out of a wall panel that is bent out of the wall limb around a lower axis, whereby the wall web with the protruding slope lug extends from the bent-out upper edge section of the wall panel. Due to the impact of the slope lug when the end strip is pushed onto the holding web of the holder, the wall web is on the one hand pivoted against the wall around a bending axis in the connection area to the upper edge section of the wall panel and on the other hand, due to the associated pivoting of the wall panel around the lower bending axis, is additionally displaced towards the wall, which provides good conditions for effective claw engagement in the wall. The bent out upper edge section of the wall panel can form the holding web for clampingly receiving the end strip, but this is by no means mandatory because the wall limb can also have two holding webs provided laterally next to the wall panel, for example, which are not influenced by the movement of the wall panel.

Simple design conditions also result when the slope lug is formed as a tongue punched out of the wall web and extending from the bottom edge of the wall web, because in this case a corresponding torque can be exerted in a simple manner on the bottom edge of the wall web so that the wall web is pivoted about an upper bending axis.

In order to protect not only the holder from being unintentionally lifted out of the connection joint, but also the end strip from being unintentionally pulled off the holder, the holder can have a latching projection formed by the slope lug and/or the holding web and engaging in a latching groove of the end strip. This latching projection, which engages resiliently in the latching groove when the end strip is pushed onto the holding web, holds the end strip against unintentional removal from the holding web of the holder.

BRIEF DESCRIPTION OF THE INVENTION

In the drawing, the object of the invention is shown by way of example. It shows FIG. 1 a simplified front view of a holder for an end strip according to the invention, FIG. 2 a top view of this holder, FIG. 3 a section along line III-III of FIG. 1 on a larger scale, FIG. 4 a representation corresponding to FIG. 1 of an embodiment of a holder for an end strip according to the invention, FIG. 5 a top view of the holder according to FIG. 4, FIG. 6 a section along line VI-VI of FIG. 4 on a larger scale, FIG. 7 another embodiment of a holder for an end strip according to the invention in a simplified front view, FIG. 8 a top view of the holder according to FIG. 7 and FIG. 9 a section along line IX-IX of FIG. 7 on a larger scale.

WAYS OF CARRYING OUT THE INVENTION

Figure 2:
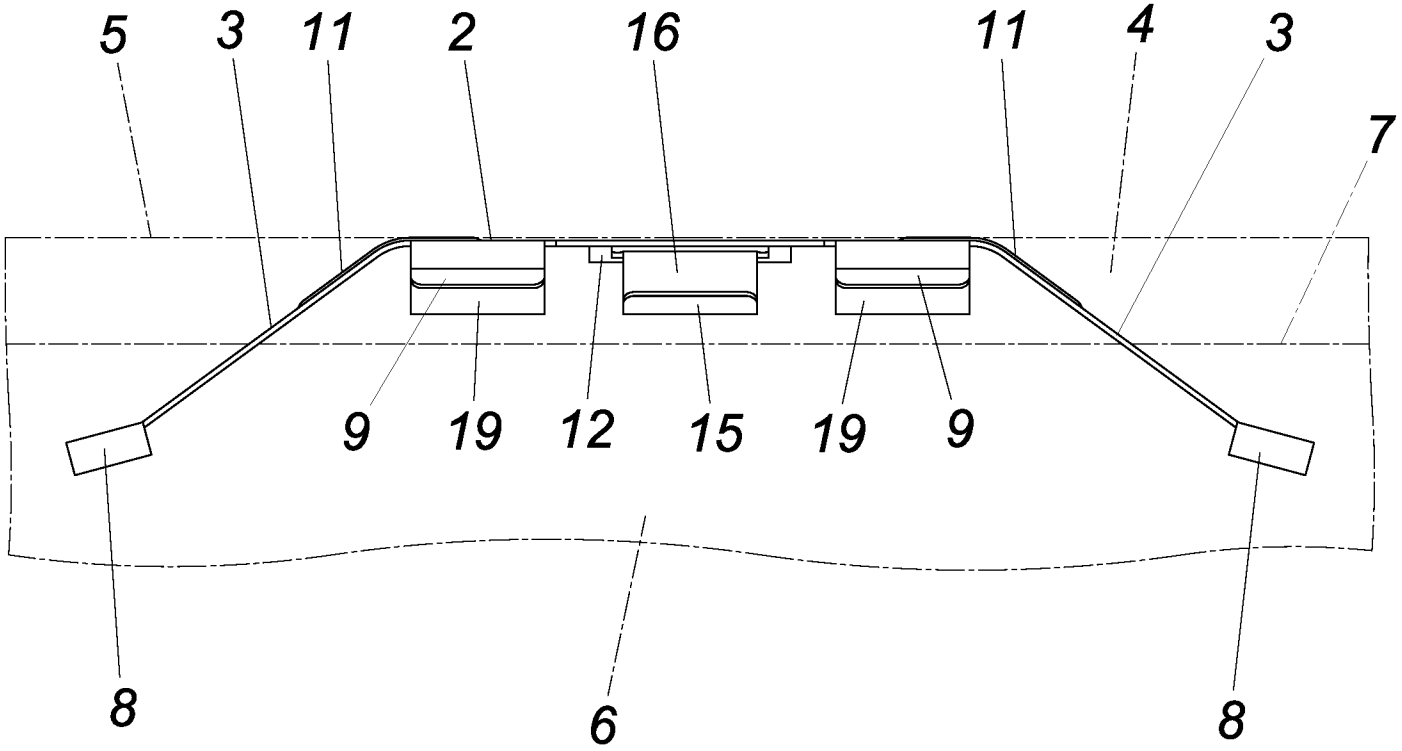
Figure 3:
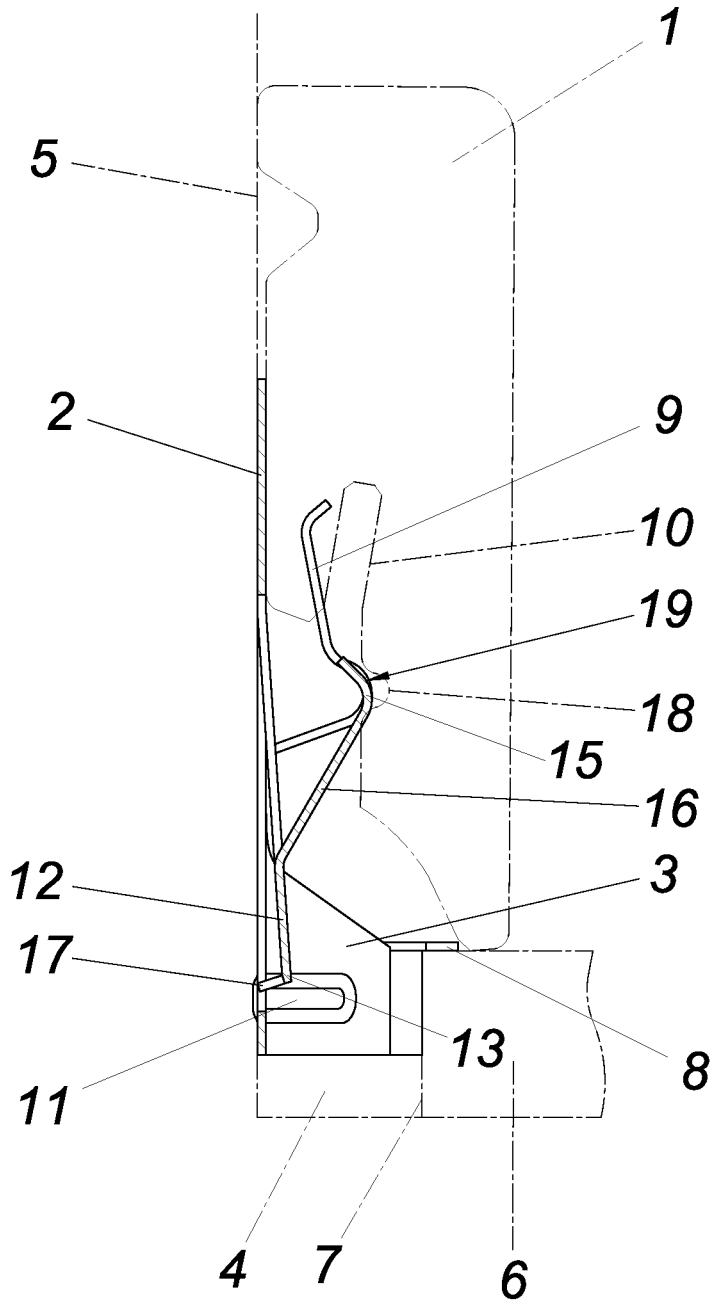

According to FIGS. 1 to 3, the device for fastening an end strip 1 comprises a holder which has a wall limb 2 with two leaf-spring-like spreading arms 3 projecting laterally therefrom. As can be seen from FIG. 2, these spreading arms 3 are swung out of the plane of the wall limb 2 and must be swung back against the spring force against the plane of the wall limb 2 to insert the holder into the connection joint 4 between a wall 5 and a flooring 6. After being released, the swivelled back spreading arms 2 rest against the end face 7 of the flooring 6 under elastic pre-tension, as shown in FIG. 3.

With the aid of a stop 8 at the free end of the spreading arms 3 the holder is supported on the flooring 6 in terms of height. With the elastic spreading by the spreading arms 3, the wall limb 2 is held pressed against the wall 5 so that the end strip 1 can be placed on two holding webs 9, which project upwards from the wall limb 2 and engage in a downwardly open groove 10 of the end strip 1 to clamp the end strip 1. The spreading arms 3 can be provided with beads 11 to influence the spring stiffness.

As can be seen in particular from FIGS. 1 and 3, the holder has a wall web 12 punched out of the wall limb 2 and bounded by a bottom edge 13 parallel to the base and two side edges 14 extending therefrom. At a height distance from the bottom edge 13, the wall web 12 is provided with a slope lug 15 projecting from the wall limb 2 for the end strip 1 in the form of a tongue 16 punched out of the wall web 12 and extending from the bottom edge 13 of the wall web 12. If the end strip 1 indicated by a dotted line in FIG. 3 is pushed onto the holding webs 9, the end strip 1 runs onto the slope lug 15, whereby the wall web 12 is pressed against the wall 5 with a force which presses the claws 17 provided on the bottom edge 13 of the wall web 12 and projecting towards the wall 5 into the wall 5 and thus prevents the wall limb 2 from being pulled out of the connection joint 4 along the wall 5.

FIG. 3 shows the holder in the unloaded, relaxed position before the end strip 1 is fitted, so that the displacements of the holding webs 9 on the one hand and the slope lug 15 on the other hand caused by the end strip when the end strip 1 is fitted onto the holding webs 9 can be seen.

To prevent the end strip 1 from being pulled off the holder, the end strip 1 is provided with a latching groove 18 into which latching projections 19 snap. These latching projections 19 can be formed by corresponding bulges of the holding webs 9 and/or by the slope lug 15.

Figure 4:
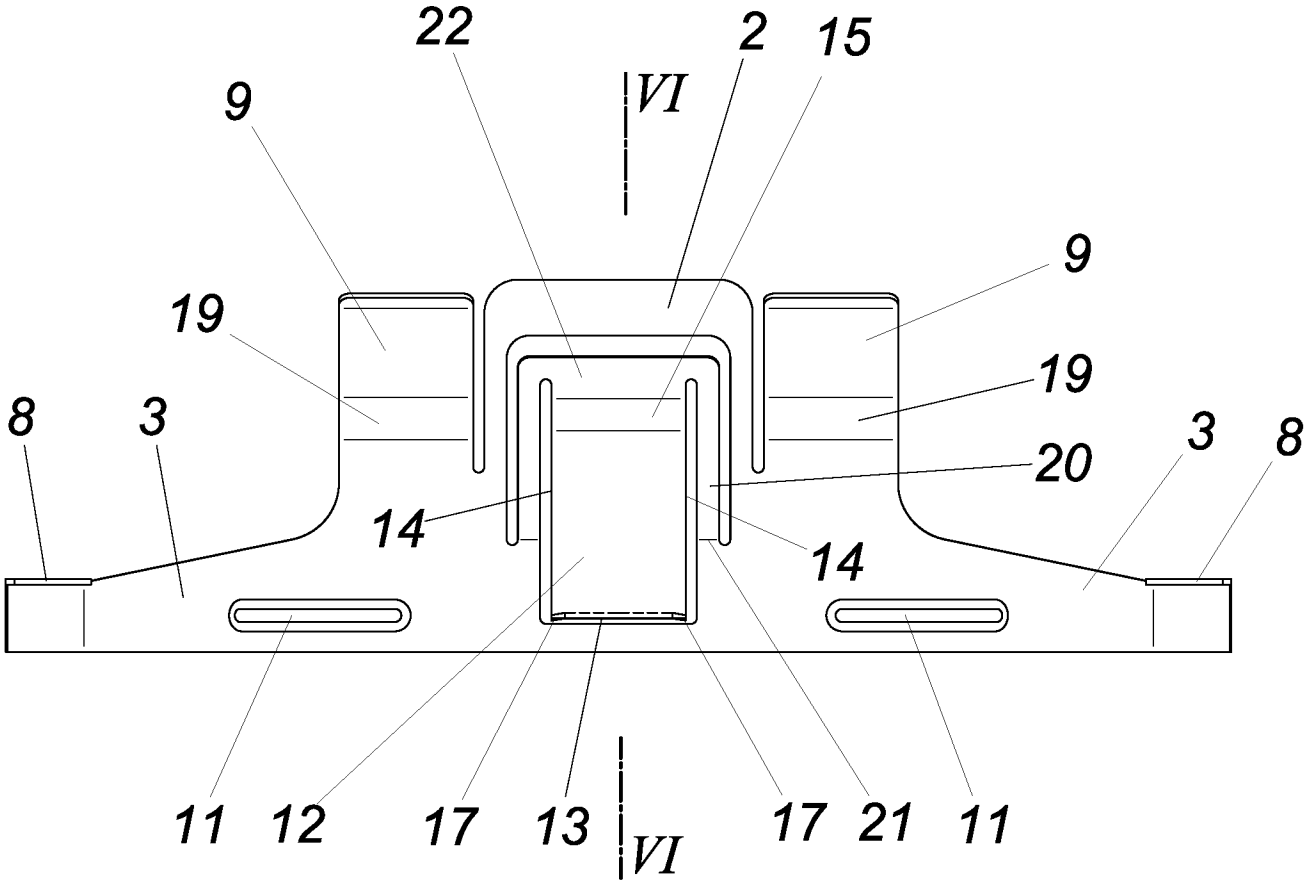
Figure 5:
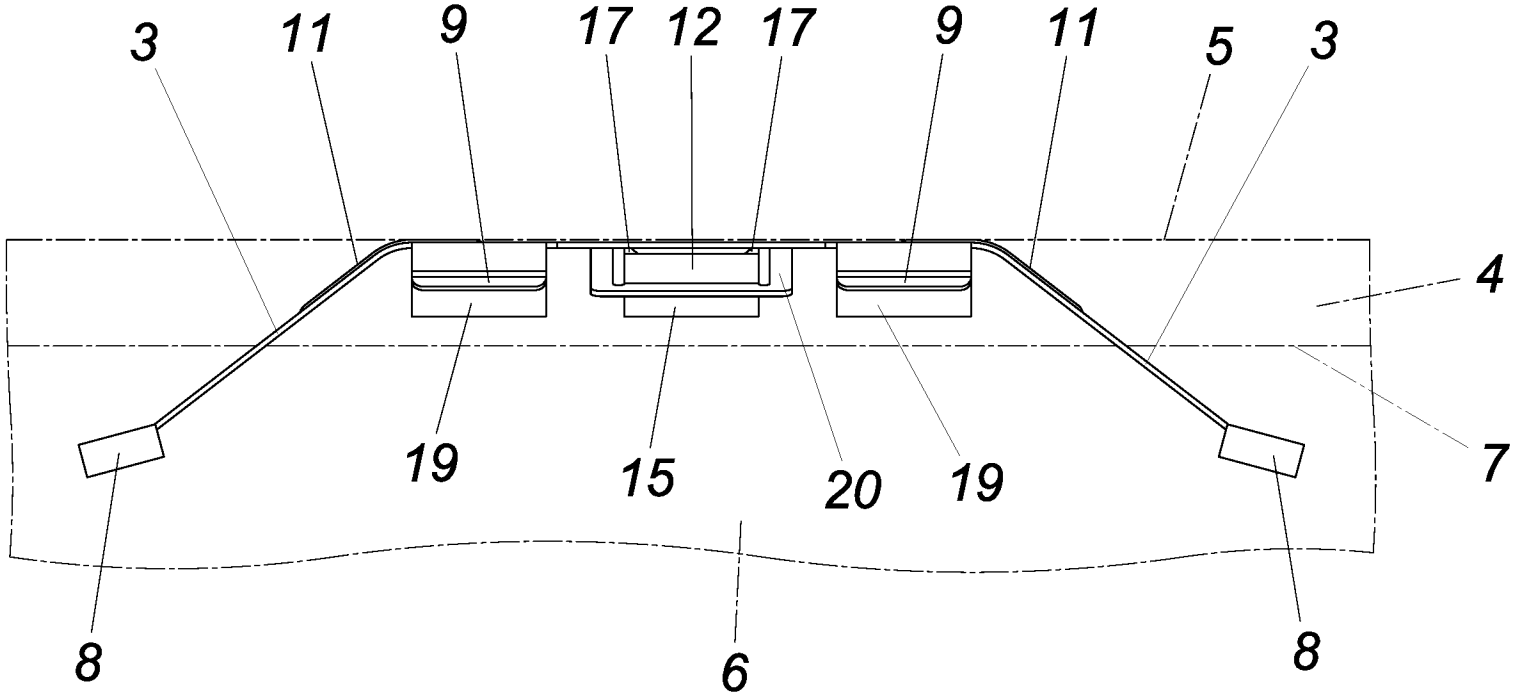
Figure 6:
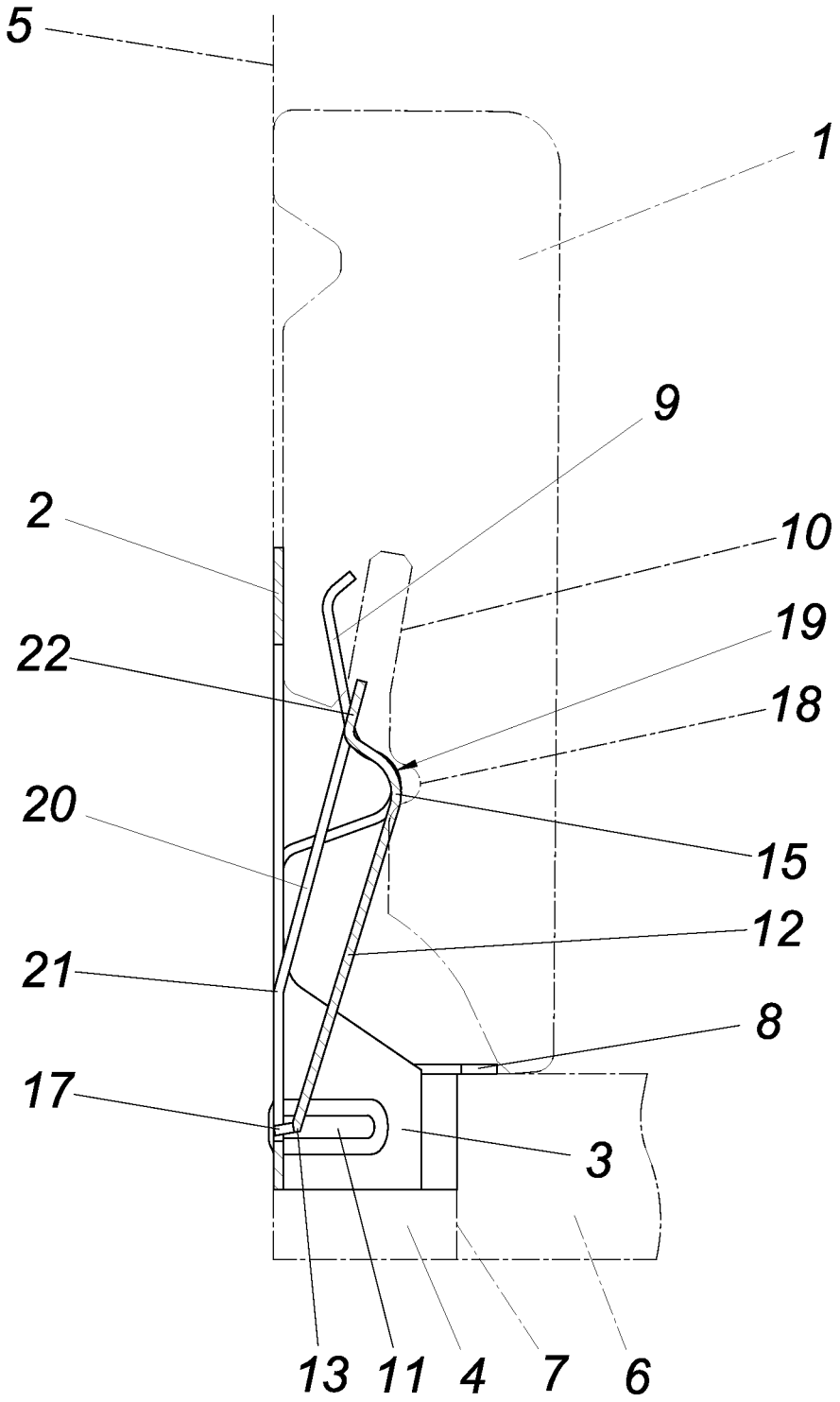

The embodiment according to FIGS. 4 to 6 differs from the embodiment according to FIGS. 1 to 3 essentially only in the shaping of the wall limb 2 to form the wall web 12, which is not punched directly out of the wall limb 2 but out of a wall panel 20 bent out of the wall limb 2. The wall panel 20 punched out of the wall limb 2 is bent out of the wall limb 2 about a lower axis 21, the wall web 12 with the slope lug 15 extending from the upper edge section 22 of the wall panel 20.

If, when the end strip 1 is fitted onto the holding webs 9, the slope lug 15 of the wall web 12 is acted upon and thereby pressed against the wall 5, this action causes, on the one hand, a torque on the wall web 12 around an axis in the region of connection of the wall web 12 to the upper wall section 22 of the wall panel 20 and, on the other hand, a torque on the wall panel 20 around the bending axis 21, whereby a displacement of the bottom edge 13 of the wall web 12 against the wall 5 is ensured which is advantageous for an engagement of the claws 17 with the wall 5.

Figure 7:
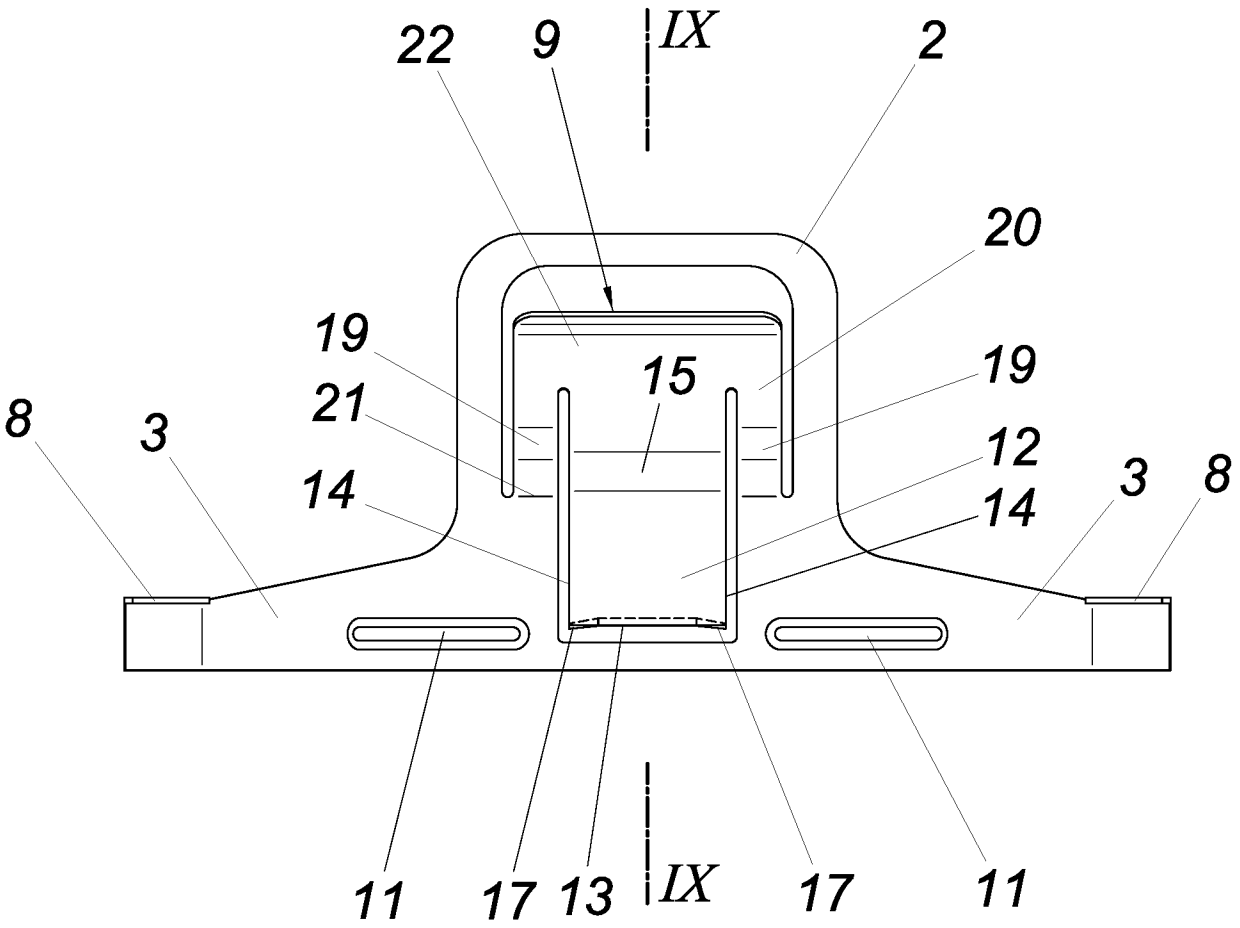
Figure 8:
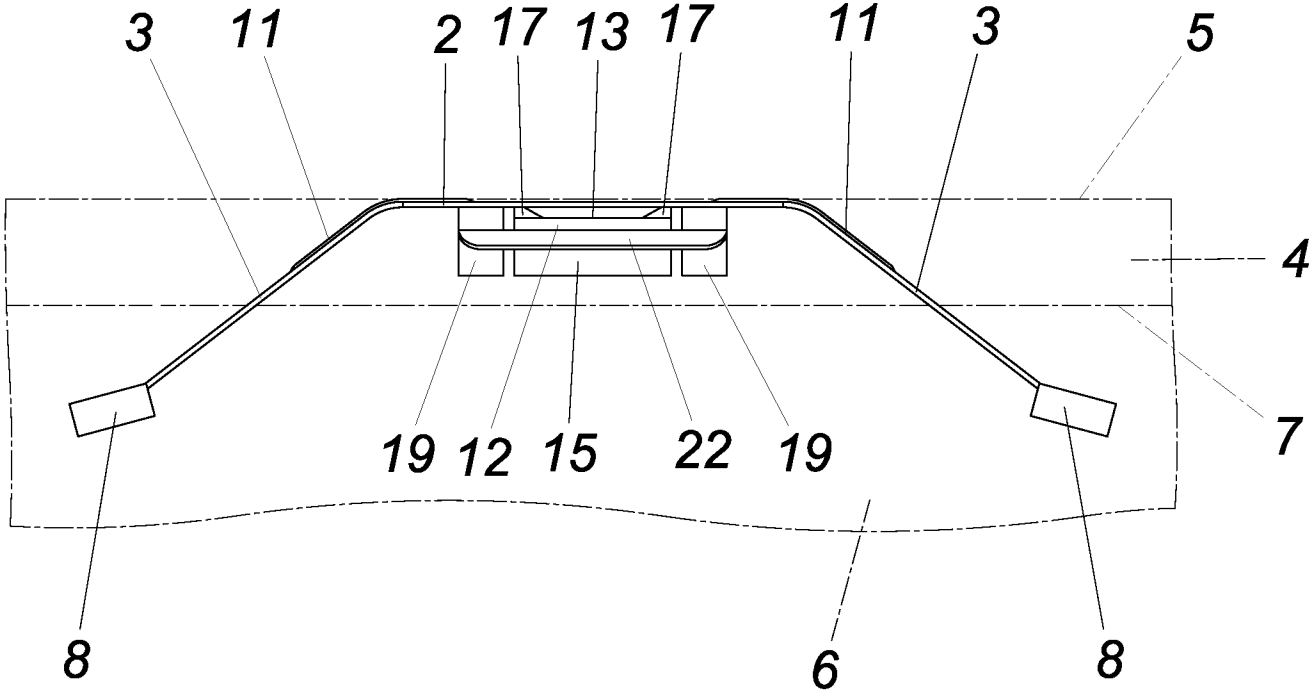
Figure 9:
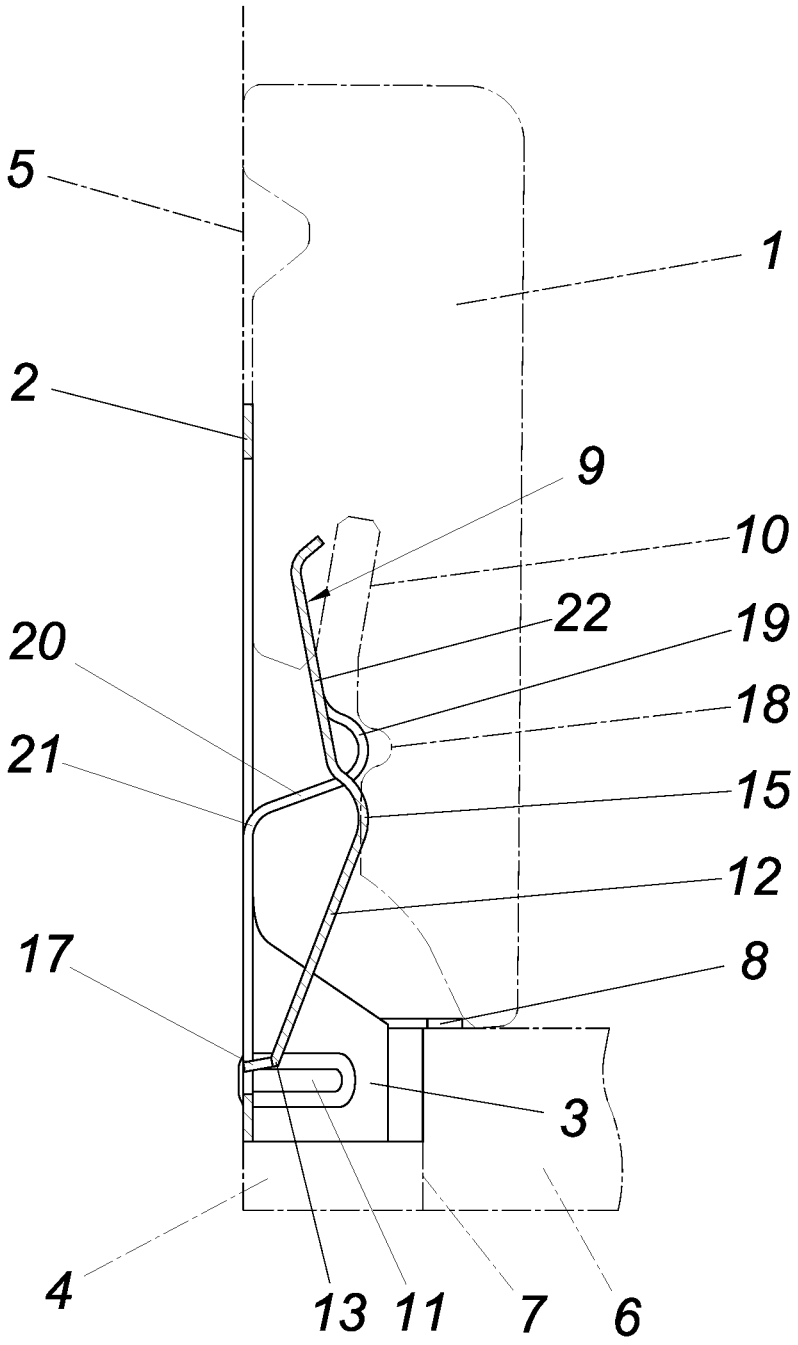

According to the embodiment of FIGS. 7 to 9, the wall web 12 is again punched out of a wall panel 20, which is bent out of the wall limb 2 of the holder about the axis 21, as in FIGS. 4 to 6. In contrast to FIGS. 4 to 6, however, the upper edge section 22 of the wall panel 20 bent out of the wall limb 2 forms the holding web 9. This circumstance means that the upper edge section 22, which serves as the holding web 9, is bent away from the wall limb 2 when the end strip 1 is fitted, as is usually the case with holding webs 9 due to their orientation relative to the groove 10 of the end strip 1, in order to press the end strip 1 against the wall limb 2 or against the wall 5 under pretension. This additional pivoting movement of the wall panel 20 causes the wall web 12 supported by the wall panel 20 to also pivot with the effect that the impact on the wall web 12 via the slope lug 15 is supported by this superimposed pivoting movement, so that the claws 17 on the bottom edge 13 of the wall web 12 find a secure hold in the wall 5.

The embodiment according to FIGS. 7 to 9 also shows that the snap-fastener-like latching between the holder and the end strip 1 with the aid of latching projections 19 engaging in a latching groove 18 of the end strip 1 can also be achieved only with the aid of bulges formed on the holding webs 9, just as it is also possible to use only the run-on lug 15 as a latching projection.

The invention claimed is:

1. A device for fastening an end strip having a downwardly open groove and covering a connection joint between a wall and a flooring, said device comprising:

a holder that forms a wall limb, the holder having at least one upwardly projecting holding web configured to engage in the downwardly open groove of the end strip so as to clampingly receive the end strip, and two spreading arms attached laterally to the wall limb and projecting towards an end face of the flooring;

wherein the holder comprises a wall web formed from the wall limb and delimited by a bottom edge and two side edges extending from said bottom edge; wherein the bottom edge of the wall web has claws projecting towards the wall; and wherein the wall web has, at a distance in height from the bottom edge, a slope lug engageable with the end strip projecting from the wall limb.

2. The device according to claim 1, wherein the wall web is formed from a wall panel that is bent out of the wall limb around a lower axis and from a bent-out upper edge section of the wall panel the wall web with the projecting slope lug extends.

3. The device according to claim 2, wherein the bent-out upper edge section of the wall panel forms the holding web clamping the end strip.

4. The device according to claim 1, wherein the slope lug is a tongue punched out of the wall web and extending from the bottom edge of the wall web.

5. The device according to claim 1, wherein the end strip has a latching groove, and the holder has a latching projection formed by the slope lug and/or the holding web and engaging in the latching groove of the end strip.

6. The device according to claim 2, wherein the end strip has a latching groove, and the holder has a latching projection formed by the slope lug and/or the holding web and engaging in the latching groove of the end strip.

7. The device according to claim 3, wherein the end strip has a latching groove, and the holder has a latching projection formed by the slope lug and/or the holding web and engaging in the latching groove of the end strip.

8. The device according to claim 4, wherein the end strip has a latching groove, and the holder has a latching projection formed by the slope lug and/or the holding web and engaging in the latching groove of the end strip.

9. The device according to claim 1, wherein the wall web is punched out of the wall limb.

10. The device according to claim 2, wherein the wall web is punched out of the wall panel.

11. The device according to claim 3, wherein the wall web is punched out of the wall limb.

12. The device according to claim 4, wherein the wall web is punched out of the wall limb.

13. The device according to claim 5, wherein the wall web is punched out of the wall limb.

14. The device according to claim 6, wherein the wall web is punched out of the wall limb.

15. The device according to claim 7, wherein the wall web is punched out of the wall limb.

16. The device according to claim 8, wherein the wall web is punched out of the wall limb.

17. The device according to claim 1, wherein the spreading arms each act as a leaf-spring.

* * * * *